US008474283B2

(12) United States Patent
Kim

(10) Patent No.: US 8,474,283 B2
(45) Date of Patent: Jul. 2, 2013

(54) REFRIGERATOR

(75) Inventor: Seong Wook Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 874 days.

(21) Appl. No.: 12/634,352

(22) Filed: Dec. 9, 2009

(65) Prior Publication Data

US 2010/0175412 A1 Jul. 15, 2010

Related U.S. Application Data

(60) Provisional application No. 61/145,014, filed on Jan. 15, 2009.

(51) Int. Cl.
*F25C 5/02* (2006.01)

(52) U.S. Cl.
USPC ..... 62/320; 62/344; 62/449

(58) Field of Classification Search
USPC ..... 62/320, 344, 137, 139, 381, 449
See application file for complete search history.

(56) References Cited

U.S. PATENT DOCUMENTS

| | | | | |
|---|---|---|---|---|
| 6,904,765 | B2 * | 6/2005 | Lee et al. | 62/320 |
| 7,134,292 | B2 * | 11/2006 | Oh | 62/137 |
| 2005/0072167 | A1 * | 4/2005 | Oh | 62/137 |
| 2005/0183441 | A1 * | 8/2005 | Lee et al. | 62/340 |
| 2006/0090485 | A1 * | 5/2006 | Lee et al. | 62/135 |
| 2006/0117784 | A1 * | 6/2006 | Yang | 62/340 |
| 2006/0213213 | A1 * | 9/2006 | Chung et al. | 62/344 |
| 2008/0034779 | A1 * | 2/2008 | Lee et al. | 62/344 |
| 2008/0061088 | A1 * | 3/2008 | Park et al. | 222/477 |
| 2008/0156024 | A1 * | 7/2008 | Shin et al. | 62/344 |
| 2008/0256962 | A1 * | 10/2008 | Lee et al. | 62/137 |

* cited by examiner

*Primary Examiner* — Mohammad M Ali
(74) *Attorney, Agent, or Firm* — Birch, Stewart, Kolasch & Birch, LLP

(57) ABSTRACT

Provided is a refrigerator including a mixing box detachably provided on a refrigerator door. Due to the mixing box, a user can conveniently utilize a beverage having a slushy shape.

23 Claims, 7 Drawing Sheets

REFRIGERATOR

This Non-Provisional application claims priority under 35 U.S.C. 119(e) on U.S. Provisional Application No. 61/145,014, filed on Jan. 15, 2009, which is hereby incorporated by reference in its entirety.

BACKGROUND

Embodiments relate to refrigerator.

Generally, a refrigerator includes a plurality of storage compartments for receiving foods to store the foods in freezing or refrigeration state. One surface of each of the storage compartments is opened to receive and dispense the foods.

A door selectively covering the storage compartment is provided in a front direction of the storage compartment. An ice-making device for making ice and a dispenser device for dispensing the ice may be provided in the door.

DETAILED DESCRIPTION OF THE EMBODIMENTS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
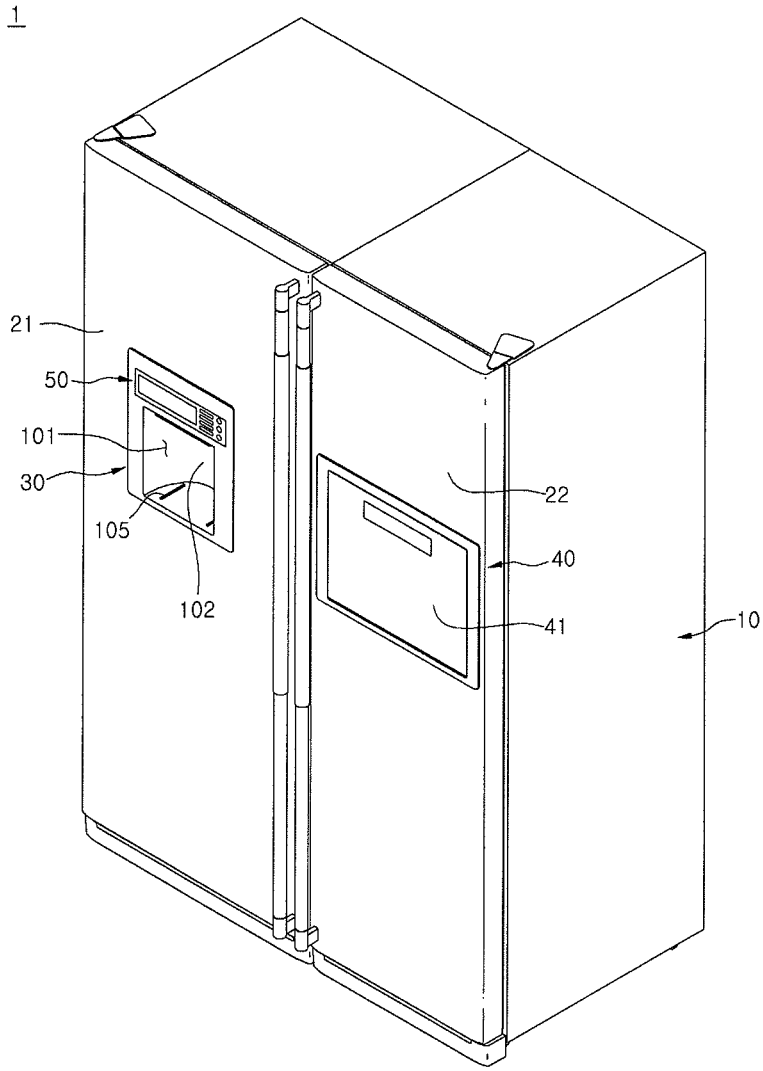
FIG. 1 is a perspective view of a refrigerator according to an embodiment.
Figure 2:
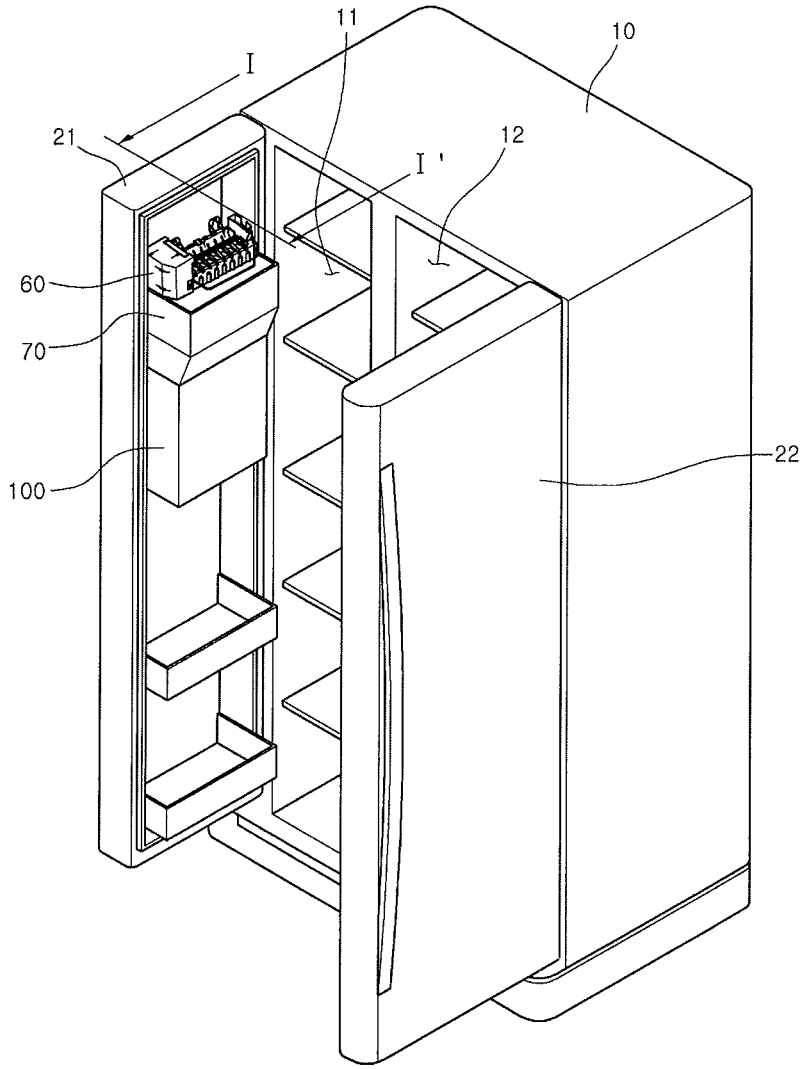
FIG. 2 is a perspective view of one state in which a refrigerator door is opened according to an embodiment.

FIG. 1 is a perspective view of a refrigerator according to an embodiment, and FIG. 2 is a perspective view of one state in which a refrigerator door is opened according to an embodiment.

Referring to FIGS. 1 and 2, a refrigerator 1 according to this embodiment includes a main body 10 defining a refrigerator compartment 11 and a freezer compartment 12 and having an opened front surface and doors 21 and 22 provided on the front surface of the main body 10 and rotatably coupled to the main body 10.

The doors 21 and 22 include a refrigerator compartment door 21 for selectively covering the refrigerator compartment 11 and a freezer compartment door 22 for selectively covering the freezer compartment 12. Here, the freezer compartment door 11 and the refrigerator compartment door 12 are disposed next to each other in left and right directions.

In this embodiment, a side by side type refrigerator in which a refrigerator compartment and a freezer compartment are respectively disposed in left and right sides is described as an example. However, the present disclosure is not limited thereto. For example, a refrigerator according to this embodiment may be applied to following various refrigerators: a top mount type refrigerator in which a refrigerator compartment is disposed under a freezer compartment; and a bottom freezer type refrigerator in which a refrigerator compartment is disposed above a freezer compartment.

In detail, a display part 50 for displaying an operation state of the refrigerator 1 is provided in the freezer compartment door 21. The display part 50 includes a display unit for displaying a screen and a plurality of input units for inputting a predetermined operation command, particularly, a dispensing command of ice.

A dispenser device 100 for dispensing water or ice is provided in the freezer compartment door 21. The dispenser device 100 may be disposed at a side of the display part 50.

The dispenser device 100 includes a depression portion 101 depressed backwardly from a front surface of the freezer compartment door 21. A container such a cup for receiving the dispensed water or ice may be disposed on the depression portion 101.

A guide rib 105 for guiding a movement of a mixing box (See reference numeral 200 of FIG. 4) that will be described later is provided on a bottom surface of the depression portion 101. The guide rib 105 protrudes upwardly from the bottom surface of the depression portion 101. A plurality of guide ribs 105 may be provided on both sides of the depression portion 101.

A distance between the guide ribs 105 corresponds to a width of a bottom surface of the mixing box 200. A user can dispose the mixing box 200 at an operation position by pushing the mixing box 200 in a rear direction in a state where the mixing box 200 is fitted between the guide ribs 105.

An ice-maker 60 for making the ice and an ice bank 70 for storing the ice made in the ice-maker 60 are provided on a back surface of the freezer compartment door 21. The ice bank 70 may be disposed below the ice-maker 60, and the dispenser device 100 may be disposed below the ice bank 70.

The ice made in the ice-maker 60 drops into the ice bank 70, and then, is stored in the ice bank 70. The ice stored in the ice bank 70 may be dispensed to the outside through the dispenser device 100.

Figure 3:
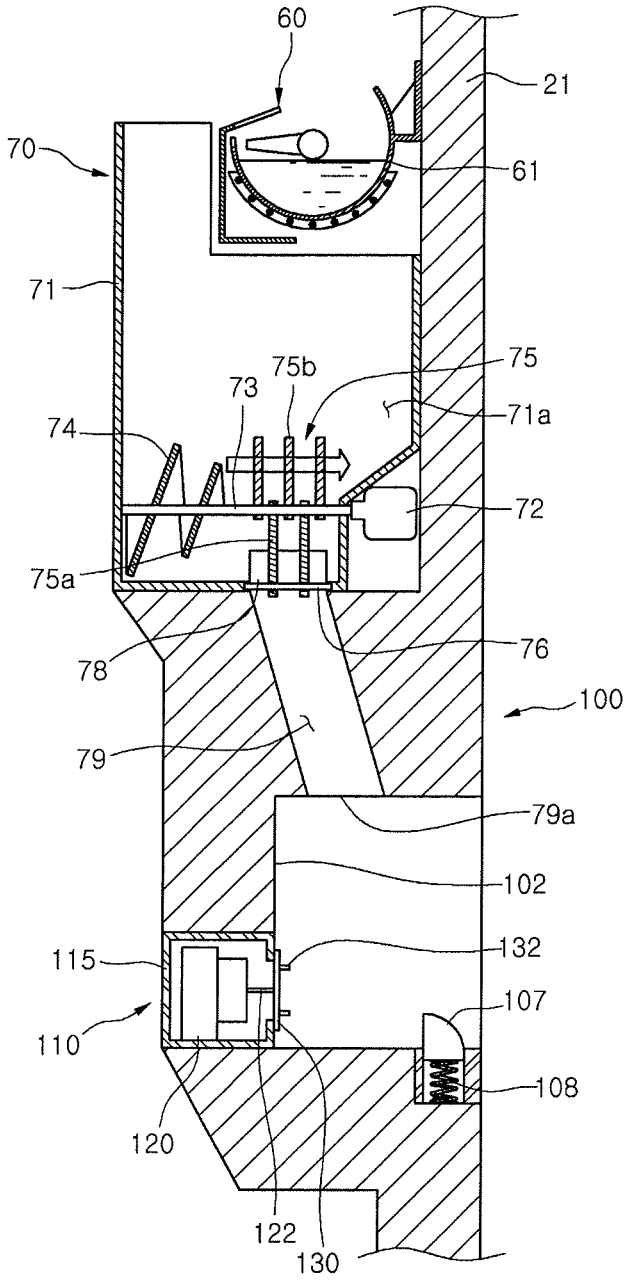
FIG. 3 is a cross-sectional view taken along line I-I' of FIG. 2.

FIG. 3 is a cross-sectional view taken along line I-I' of FIG. 2.

Referring to FIG. 3, the freezer compartment door 21 according to this embodiment includes the ice-maker 60 in which water is supplied from the outside to make the ice, the ice bank 70 in which the ice made in the ice-maker 60 is stored, and the dispenser device 100 for dispensing the ice stored in the ice bank 70.

In detail, the ice-maker 60 includes an ice tray 61 for making the ice from the supplied water. A storage space for storing the water is defined in the ice tray 61. Although the ice tray is defined as the storage space having an approximately semicircular shape in FIG. 3, but the ice tray is not limited to their shape.

The ice bank 70 includes a casing 71 in which an ice receiving chamber 71*a* for storing the ice is defined and defining an outer appearance of the ice bank 70, a dispensing motor 72 provided inside the casing 71 to generate a driving force, a rotation shaft 73 rotating by the driving force of the dispensing motor 72, a conveying part 74 connected to the rotation shaft 73 and conveying the ice received in the ice receiving chamber 71*a* toward a dispensing direction, and an ice crusher 75 provided at a side of the conveying part 74 and crushing the conveyed ice.

The dispensing motor 72 is disposed adjacent to one sidewall of the casing 71, and the rotation shaft 73 extends from the dispensing motor 72 toward the other sidewall of the casing 71.

The conveying part 74 and the ice crusher 75 are rotatably provided with respect to the rotation shaft 73.

An auger having a spiral shape may be applied to the conveying part 74 in order to smoothly convey the ice.

The ice crusher 75 includes a fixed blade 75*a* fixed with respect to the casing 71 and a rotation blade 75*b* rotating with respect to the fixed blade 75*a*.

The rotation shaft 73 is simply inserted and supported into/to the fixed blade 75*a*. Thus, the fixed blade 75*a* does not rotate but is fixed even through the rotation shaft 73 rotates.

A blade fixing part 76 provided at a side of the casing 71 to fix the fixed blade 75*a* to the casing 71 is provided at a side of the fixed blade 75*a*.

On the other hand, the rotation blade 75*b* may be connected to the rotation shaft 73 to rotate by the rotation of the rotation shaft 73.

An outlet port 78 for discharging the crushed ice is disposed below the ice crusher 75. A discharge passage 79 for moving the discharged ice into the dispenser device 100 is provided below the outlet port 78. An end portion of a side of the discharge passage 79 is defined as a discharge part 79*a*. The ice discharged from the discharge part 79*a* may be transferred to the user through the dispenser device 100.

An operation of the ice bank 70 will be simply described.

The ice made in the ice-maker 60 drops and is stored into the ice receiving chamber 71*a*. When the motor 72 operates, the rotation shaft 73 rotates. Thus, the conveying part 74 rotates according to the rotation of the rotation shaft 73. The ice received in the ice receiving chamber 71*a* is conveyed toward the ice crusher 75 along the conveying part 74.

The conveyed ice is crushed by the ice crusher 75, and the crushed ice is discharged through the outlet port 78. The discharged ice is discharged to the outside of the dispenser device 100 through the discharge passage 79 and the discharge part 79*a*.

Although not shown, a shutter for adjusting a size of the ice discharged through the outlet port 78 may be provided in the ice bank 70. The shutter is provided at a side of the outlet port 78 and openable by their rotation. When the shutter is opened, the ice having a relatively large size may be discharged, and when the shutter is closed, the ice crushed by the fixed blade 75*a* to have a relatively small size may be discharged.

The dispenser device 100 includes the depression portion 101 depressed in a backward direction of the door 21 and a rear surface portion 102 disposed on a rear side of the depression portion 101 and defining one surface of the dispenser device 100.

A drive assembly 110 for providing a predetermined driving force to operate the mixing box 200 that will be described later is provided at a rear side of the rear surface portion 102. The drive assembly 110 may be fixed to the inside of the freezer compartment door 21 using a coupling method.

In detail, the drive assembly 110 includes a drive motor 120 and a drive shaft 122 for providing a driving force and a motor housing 115 for receiving the drive motor 120.

The drive motor 120 is disposed adjacent to one sidewall of the motor housing 115, and the drive shaft 122 extends from the drive motor 120 toward the rear surface portion 102.

A rotation plate 130 and rotation protrusions 132 are provided at a side of the drive shaft 122. The rotation plate 130 rotates in a predetermined direction according to the rotation of the drive shaft 122. The rotation protrusions 132 protrude in a front direction of the rotation plate 130 and are coupled to the mixing box 200.

The rotation plate 130 is disposed in a front direction of the rear surface portion 102 and adjacent to the rear surface portion 102.

A hook member 107 elastically movable in upward and downward directions is provided on a bottom surface of the depression portion 101. An elastic member 108 for providing a restoration force to the hook member 107 is provided below the hook member 107.

The elastic member 108 has one side fixed to the inside of the freezer compartment door 21 and the other side fixed to a lower side of the hook member 107.

In a state where mixing box 200 is received into the depression portion 101, the hook member 107 is supported to a lower portion of a front surface of the mixing box 200. That is, a length of front and rear directions of a bottom surface of the mixing box 200 corresponds to a distance between the rear surface portion 102 and the hook member 107.

Figure 4:
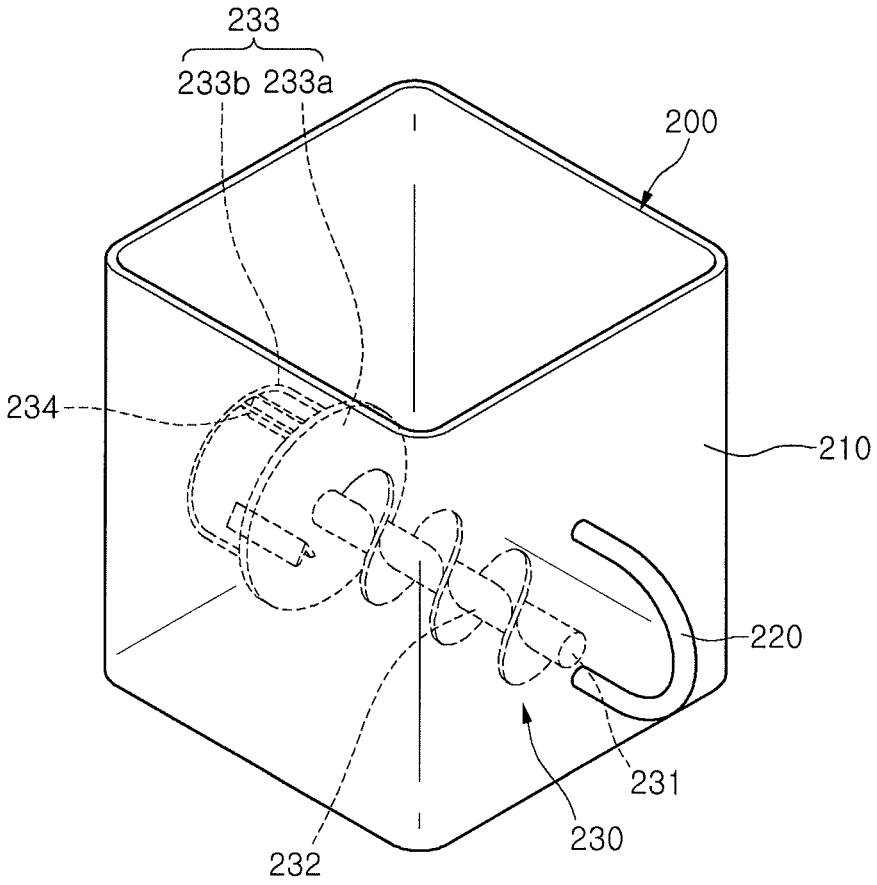
FIG. 4 is a perspective view illustrating a configuration of a mixing box according to an embodiment.
Figure 5:
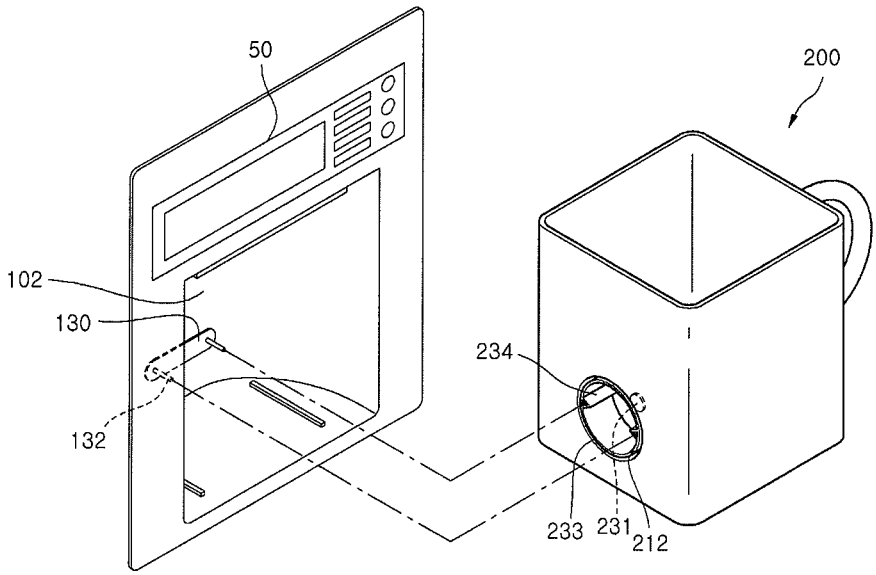
FIG. 5 is a perspective view illustrating a coupling structure of a mixing box according to an embodiment.

FIG. 4 is a perspective view illustrating a configuration of a mixing box according to an embodiment, and FIG. 5 is a perspective view illustrating a coupling structure of a mixing box according to an embodiment.

Referring to FIGS. 4 and 5, the refrigerator 1 according to this embodiment includes the mixing box 200 received into the depression portion 101 to mix the ice supplied from the ice bank 70 with a drinking liquid. The mixing box 200 may be selectively coupled to the dispenser device 100.

In detail, the mixing box 200 includes a box body 210 having an opened top surface and defining a mixing space therein, a mixing guide 230 provided inside the box body 210 to mix the ice with the drinking liquid, and a handle 220 for grasping the mixing box 200.

The mixing guide 230 includes a rotation center portion 231 and a coupling member 233. The rotation center portion 231 rotates by the rotation force of the drive motor 120. The coupling member 233 is provided at a side of the rotation center portion 231 and coupled to the rotation protrusions 132.

The rotation center portion 231 is a rotation shaft rotating by the rotation force of the drive motor 120 and passes through the coupling member 233. The rotation center portion 231 may integrally rotate with the coupling member 233.

A plurality of rotation wings 232 for mixing the ice stored in the box body 210 with the drinking liquid is provided outside the rotation center portion 231. When the rotation center portion 231 rotates, the rotation wings 232 rotate to easily mix the ice with the drinking liquid.

The coupling member 233 includes a through part 233*a* through which the rotation center portion 231 passes and having a circular shape and a coupling part 233*b* extending forwardly from the through part 233*a* and having a cylindrical shape.

A plurality of guide members 234 for guiding the rotation protrusions 132 is provided on the coupling part 233*b*. A number of guide members may correspond to a number of rotation protrusions 132 at positions corresponding to those of the rotation protrusions 132.

The guide members 234 protrude inwardly from the coupling part 233*b*, and the rotation protrusions 132 are received into the guide members 234, respectively.

Each of the guide members 234 may have a "V"-shape in section. In this case, when the rotation protrusions 132 are received into the guide members 234, the rotation protrusions 132 may be closely attached to the guide members 234, respectively.

However, if the rotation protrusions 132 are received into the guide members 234 to rotate together with each other, each of the guide members 234 may not be limited to their shape.

A through hole 212 through which the coupling member 233 passes is defined in one side surface of the box body 210. A support 237 for rotatably supporting the rotation center portion 231 is disposed on the other side surface of the box body 210.

Figure 6:
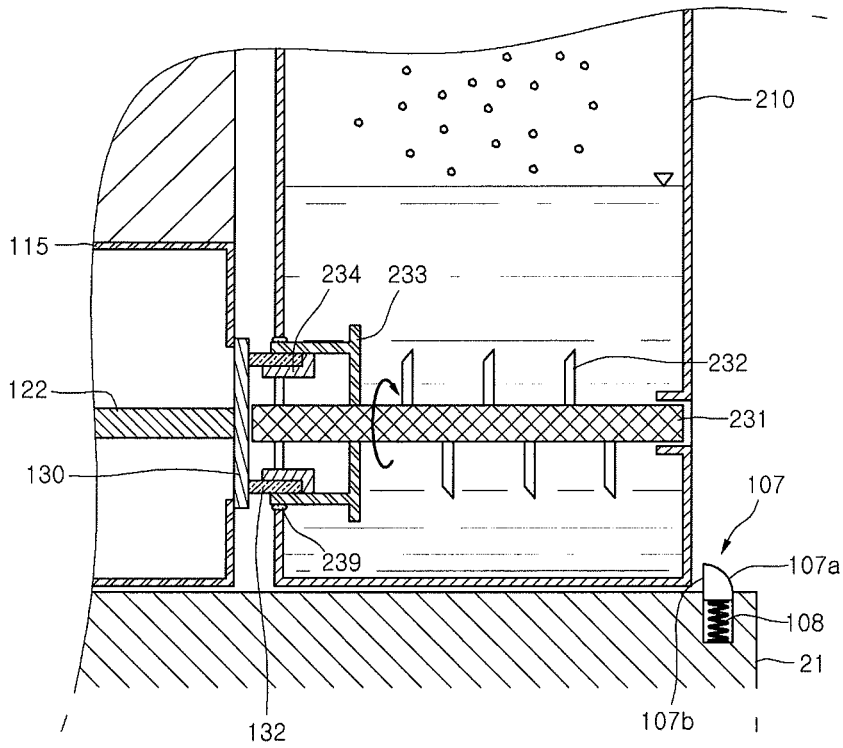
FIG. 6 is a cross-sectional view of a state in which a mixing box is coupled to a refrigerator door according to an embodiment.

A sealing member 234 for sealing the inside of the box body 210 is provided between the coupling member 233 and the box body 210 (referring to FIG. 6).

A rotation space portion for the rotation of the rotation plate 130 and the rotation protrusions 132 is defined in the rear surface portion 102. The rotation space portion is defined by passing through a portion of the rear surface portion 102.

The rotation plate 130 may be rotatably disposed in a front direction of the rotation space portion. As previously described above, the drive shaft 122 is connected to a rear side of the rotation plate 130. Thus, when the drive motor 120 rotates, the rotation plate 130 connected to the drive shaft 122 may rotate.

Hereinafter, a coupling operation between the mixing box and the refrigerator door according to this embodiment will be described.

FIG. 6 is a cross-sectional view of a state in which a mixing box is coupled to a refrigerator door according to an embodiment.

Referring to FIG. 6, the mixing box 200 according to this embodiment may be selectively coupled to the dispenser device 100.

The user throws a desired amount of the drinking liquid into the mixing box 200, and then, the mixing box 200 may be coupled to the dispenser device 100.

In a state where the mixing box 200 is seated on the bottom surface of the depression portion 101, the mixing box 200 may be moved in a rear direction of the depression portion 101 along the guide rib 105. In this process, the hook member 107 may be moved downwardly, and the elastic member 108 may be compressed.

The hook member 107 includes an inclinedly rounded protrusion front surface portion 107*a* and a protrusion rear surface portion 107*b* hooked with the mixing box 200 and extending downwardly from an upper end of the hook member 107. Since the protrusion front surface portion 107*a* is rounded, the mixing box 200 may be easily moved inside the depression portion 101.

When the movement of the mixing box 200 is completed, the hook member 107 is moved upwardly again. In this process, the elastic member 108 may be tensioned. As a result, the protrusion rear surface portion 107*b* may be hooked on a front surface of the mixing box 200. Thus, the mixing box 200 interferes with the hook member 107 to prevent the mixing box 200 from being separated to the outside.

When the mixing box 200 is installed, the rotation protrusions 132 are received into the guide members 234 and coupled to the coupling member 233.

When the installation of the mixing box 200 is completed, the user manipulates the input units of the display part 50 to dispense the crushed ice from the ice bank 70. When the mixing button (not shown) of the input units is pushed, the drive motor 120 operates.

When the drive motor operates, the drive shaft 122, the rotation plate 130, and the rotation protrusions 132 may rotate at the same time. The coupling member 233 coupled to the rotation protrusions 132 rotates.

When the coupling member 233 rotates, the rotation center portion 231 and the rotation wings 232 may rotate. During the rotation of the rotation wings 232, the ice may be mixed well with the drinking liquid.

When the ice is mixed with the drinking liquid, the ice may act as an ice core to form a beverage having a slushy shape. When the beverage having the slushy shape is completely formed, the user separates the mixing box 200 from the dispenser device 100 to use the beverage having the slushy shape.

Although not shown, in case where the mixing box 200 is not used, a separate cap for closing the rotation plate 130 and the rotation protrusions 132 protruding from the rear surface portion 102 may be provided.

Hereinafter, another embodiment of the present disclosure will be described. When comparing this embodiment with the previously described embodiment, this embodiment is identical to the previously described embodiment except for a power transmission structure of a drive motor. Therefore, the same reference numbers will be used throughout the drawing to refer to the same or like parts as those in the previously described embodiment.

Figure 7:
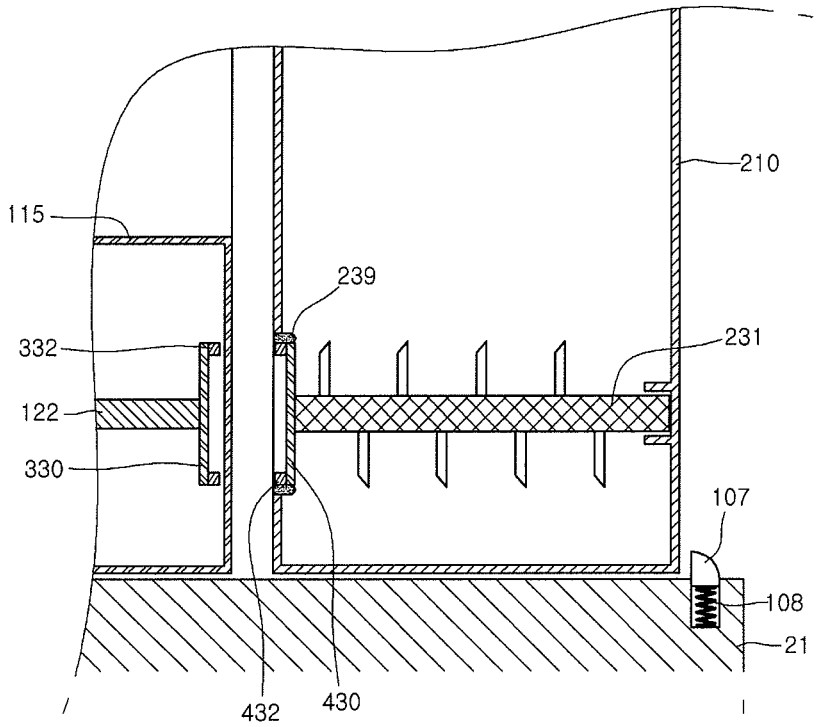
FIG. 7 is a cross-sectional view of a state in which a mixing box is coupled to a refrigerator door according to another embodiment.

FIG. 7 is a cross-sectional view of a state in which a mixing box is coupled to a refrigerator door according to another embodiment.

A freezer compartment door 21 according to this embodiment includes a drive motor 120 and a drive shaft 122 for providing a driving force, a first rotation plate 330 rotatably provided on a front surface of the drive shaft 122, and a first magnet member 332 attached to a front surface of the first rotation plate 330.

A plurality of magnet members 332 may be provided on a circumference of the first rotation plate 330. Although not shown, a magnet member having a ring shape may be attached to the circumference of the front surface of the first rotation plate 330.

A mixing box 200 includes a box body 210 defining a mixing space, a rotation center portion 231 rotatably provided inside the box body 210, a second rotation plate 430 coupled to the rotation center portion 231 to integrally rotate with each other, and a second magnet member 432 attached to a surface of the second rotation plate 430.

The second magnet member 432 may be disposed adjacent to a surface coupled to a surface of a motor housing 115 in the box body 210.

That is, when the mixing box 200 is completely installed, the first magnet member 332 may be adjacent to the second magnet member 432. Here, the first magnet member 332 and the second magnet member 432 may have respectively polarities opposite to each other.

According to the above described configuration, when the drive motor 120 rotates, the first rotation plate 330 and the first magnet member 332 rotate. When the first magnet member 332 rotates, the second magnet member 432 may rotate in interlock with the second magnet member 332 due to magnetism between the first magnet member 332 and the second magnet member 432.

When the second magnet member 432 rotates, the second rotation plate 430 and the rotation center portion 231 rotate, and thus, rotation wings 232 may rotate. When the rotation wings 232 rotate, ice stored in the box body 210 may be easily mixed with a drinking liquid.

When the ice is mixed with the drinking liquid, the ice may act as an ice core to form a beverage having a slushy shape.

According to the above described, the user can utilize the beverage having the slushy shape according to the user's taste, thereby improving a user's convenience.

What is claimed is:

1. A refrigerator comprising:

a body having a door;

an ice bank configured to store ice;

a mixing box receiving recess located in the door;

a discharge passage connecting the recess to the ice bank;

a drive assembly disposed on the door; and a mixing box selectively engagable with the drive assembly, the mixing box being configured to receive ice and another liquid to be combined with the ice, the mixing box including a mixing member operatively connected to the drive assembly when the mixing box is engaged with the drive assembly.

2. The refrigerator of claim 1, further comprising an ice maker in communication with the ice bank.

3. The refrigerator of claim 2, wherein the ice maker is located on the door.

4. The refrigerator of claim 1, wherein the drive assembly includes:

a drive motor located at the door, the drive motor having a first rotatable shaft; and a rotation unit operatively connected to the mixing member when the mixing box is engaged with the drive assembly.

5. The refrigerator of claim 4, wherein the mixing member includes:

a second rotatable shaft having a first end and a second end, the second rotatable shaft being supported in the mixing box; and a coupling portion located at the first end, the coupling portion being operatively connected to the rotation unit when the mixing box is engaged with the drive assembly.

6. The refrigerator of claim 5, wherein the rotation unit includes:

a rotation plate connected to the first rotatable shaft; and at least one projection located on the rotation plate, wherein the coupling portion includes at least one guide member configured to receive the at least one projection.

7. The refrigerator of claim 6, wherein the at least one guide member has a "v" shaped profile.

8. The refrigerator of claim 6, wherein the rotation plate is disposed in the recess.

9. The refrigerator of claim 5, wherein the rotation unit includes:

a rotation plate connected to the first rotatable shaft; and at least one magnet located on the rotation plate, wherein the coupling portion includes at least one magnet located thereon, the at least one magnet on the coupling portion being configured to rotate when the at least one magnet on the rotation plate is rotated.

10. The refrigerator of claim 5, wherein the mixing member includes at least one blade projecting radially from the second rotatable shaft.

11. The refrigerator of claim 5, wherein the mixing box includes a rear wall, the coupling unit extending through the rear wall to be operatively connectable to the rotation unit.

12. The refrigerator of claim 11, wherein the mixing box includes a sealing member between the coupling unit and the rear wall.

13. The refrigerator of claim 1, wherein the recess includes:

a rear wall spaced from a front surface of the door;

a top wall extending from the rear wall to the front surface;

a bottom wall extending from the rear wall to the front surface; and a pair of side walls extending from the rear wall to the front surface.

14. The refrigerator of claim 13, further comprising a pair of spaced apart ribs located on the bottom wall, the ribs being configured to minimize lateral movement of the mixing box.

15. The refrigerator of claim 1, further comprising a displaceable hook member disposed at the mixing box receiving recess, the displaceable hook member being configured to retain the mixing box in the recess when the mixing box is engaged to the drive assembly.

16. The refrigerator of claim 15, further comprising an elastic member in the door, the elastic member being configured to bias the displaceable hook member in a vertical direction.

17. The refrigerator of claim 1, further comprising a display unit configured to indicate an operation state of the refrigerator.

18. The refrigerator of claim 17, wherein the display unit includes a plurality of input units.

19. The refrigerator of claim 18, wherein one of the plurality of input units includes an input for controlling operation of the drive assembly.

20. The refrigerator of claim 1, wherein the body includes a cooling compartment and a freezer compartment.

21. The refrigerator of claim 20, wherein the door is a freezer door.

22. The refrigerator of claim 1, wherein the ice bank includes an ice crusher.

23. The refrigerator of claim 1, wherein the mixing member is rotatable about a generally horizontal axis.

* * * * *